United States Patent [19]

Miller et al.

[11] Patent Number: 4,763,809

[45] Date of Patent: Aug. 16, 1988

[54] WASTE CONTAINER AND ADJUSTABLE BAG LINEAR PACKAGE HOLDER COMBINATION

[75] Inventors: David C. Miller, Ridgefield; Thomas J. Pendleton, Danbury, both of Conn.

[73] Assignee: Mobil Oil Corporation, New York, N.Y.

[21] Appl. No.: 10

[22] Filed: Jan. 2, 1987

[51] Int. Cl.[4] ..... B65D 21/02; B65D 67/02

[52] U.S. Cl. ..... 220/407; 220/23.83; 249/95; 312/333

[58] Field of Search ..... 220/23.2, 23.4, 23.83, 220/23.86, 69, 403, 407; 312/333; 297/462; 108/45, 102, 143; 211/153; 248/95, 97

[56] References Cited

U.S. PATENT DOCUMENTS

| | | | |
|---|---|---|---|
| 2,671,709 | 3/1954 | Radzyner | 312/333 |
| 2,869,620 | 1/1959 | Gleitsman | 297/462 |
| 3,195,966 | 7/1965 | Doherty | 312/333 |
| 3,553,762 | 1/1971 | Padgett | 15/257.06 |
| 3,664,622 | 5/1972 | Vaccaro | 248/95 |
| 3,856,173 | 12/1974 | Deane | 220/23.83 |
| 3,913,810 | 11/1975 | Shaw | 248/95 |
| 3,979,011 | 9/1976 | Schleicher | 220/69 |

*Primary Examiner*—George E. Lowrance

*Attorney, Agent, or Firm*—Alexander J. McKillop; Michael G. Gilman; James P. O'Sullivan, Sr.

[57] ABSTRACT

A rigid container having a bottom and walls and a peripherally depending rigid skirt for offsetting the bottom of the container from a support surface. The skirt has one or more spaced orifices and affixed to the underside of the bottom of the container is a ratchet bar. A pawl including, a pawl escapement tooth, a pawl arm and a vertical member extending at right angles to the pawl arm, is located through the orifice of the skirt so as to be in slideable engagement with the ratchet bar. This arrangement is adapted to receive a supply package of liner bags located between the upright member and the wall of the container. The supply package is of sufficient resiliency so as to permit locking engagement of the package between the upright member and the container.

4 Claims, 1 Drawing Sheet

WASTE CONTAINER AND ADJUSTABLE BAG LINEAR PACKAGE HOLDER COMBINATION

The present invention relates to the combination of a waste container having as an integral part thereof an adjustable holder for a package containing a supply of liner bags for the container.

An annoying lack of convenience in connection with waste containers requiring thin gauged film bag liners, is the fact that the liner replacement supply is usually somewhere remote from the container itself. It would amount to a significant advantage to the consumer if the container replacement liner supply were readily at hand adjacent to the container. Since boxes of bag liners come in different sizes it would be of practical necessity for the means to hold the boxes to be readily adjustable to accommodate the different sizes. Furthermore, while some liner containers are comparatively inflexible and not readily reducible in width as bag liners are removed, others may readily reduce in width and a holding means adjustable to accommodate this would be desirable.

U.S. Pat. No. 4,364,490 addresses this problem by placing a supply of bag liners under the bottom of a refuse receptable, with the bag liner supplied from through the bottom of the container. This type of structure has the disadvantages of being structurally complex and, in addition, permits leaking waste liquid to run down into the bag liner supply from holes in the bag liner. U.S. Pat. No. 4,349,123 is another version of the same concept having exactly the same problems. U.S. Pat. No. 3,888,406 provides a waste container employed with a plurality of trash liner bags in a nested arrangement positioned within the container. This structure permits the use of the innermost nested liner first and when it is full it is removed from the nested configuration and the next liner is ready for use. A serious drawback with this configuration is the difficulty involved in denesting thin film, tightly nested bag liners. The removal of the full trash liner tends to pull out the entire nested arrangement disturbing one or more of the closely nested bags. The consumer then must reinsert and rearrange the nested configuration.

It would be a significant advance in this art to provide a supply of bag liners adjacent to the waste container in a manner not having the shortcomings of the prior art.

SUMMARY OF THE INVENTION

The objects of the present invention are attained by employing a combination comprising a unique arrangement in the bottom region of a waste container including, a structure which will firmly hold packages of bag liners of different size and any of decreasing size. The combination broadly comprises at least one ratchet bar fixed in association with a planar surface; at least one pawl including a pawl escapement tooth and a pawl arm in association therewith; a fulcrum for said pawl arm, located so as to permit said pawl tooth to move into and out of engagement with the teeth of said ratchet bar; an upright member fixed at the end of said pawl arm opposite to said pawl tooth and extending in the same direction as said pawl tooth; a wall member fixed in relation to said ratchet bar and located between said ratchet bar and said upright member and generally parallel to said upright member; said pawl tooth and arm being slideable in relation to said ratchet bar, fulcrum and wall member; said combination being adapted to receive a package between said upright member and said wall member, said upright member being structured so as to exert a spring-force against said package when said pawl escapement tooth is in locked engagement with said ratchet bar.

In a preferred combination there are a pair of spaced, parallel ratchet bars, a pair of said pawls, a pair of said fulcrums and a pair of inwardly curved upright members.

The combination is best utilized wherein the above referenced planar surface is the underside of a rigid container having a bottom and side walls. This container will have a peripherally depending rigid skirt for offsetting the bottom of the container from a support surface. The skirt has a pair of spaced orifices therein functioning as the fulcrums for operation of the pawl arm and pawl escapement tooth.

DETAILED DESCRIPTION OF THE INVENTION

Figure 1:
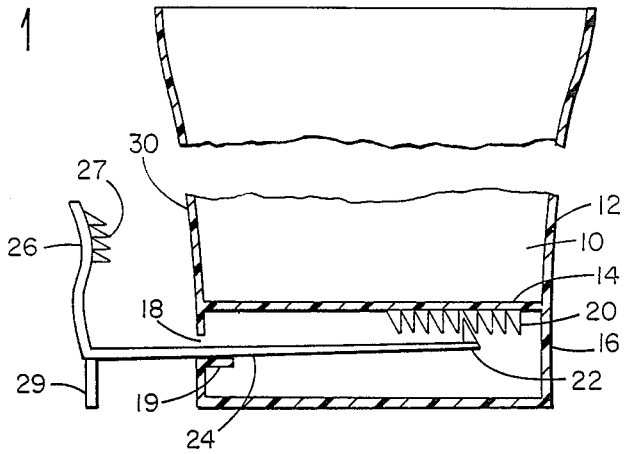
FIG. 1 is a side sectional view taken along line 2—2 of FIG. 2 of a waste container having the adjustable package holder of the present invention.

Referring to the drawings there is shown, the combination of a waste container 10, having side walls 12 and a planar bottom 14. Depending from the bottom of the container is peripheral skirt member 16. A pair of fulcrum orifices 18 extend through skirt member 16. Affixed to or molded as part of the bottom wall 14 of the container is at least one multi-tooth ratchet bar 20. Extending through orifices 18 are a pair of pawls which include a pawl escapement tooth 22, a pawl arm 24 and one or more upright members 26, which in the case of two or more, are inter-connected by cross member 28. Shelf members 19 are perpendicular extensions of orifices 18 and provide broader support for pawl arm 24. Upright members 26 can be curved as shown or angled so as to provide a spring action against a package of bag liners held between it and the waste container wall. The inside surfaces of 26 can be serrated or toothed as at 27 to more firmly grip a package of waste container liners. When a package of waste container liner bags is placed in this holding means, the center of gravity of the container may be shifted causing the container to tip sideways. This can be avoided by providing a foot or leg 29 at the underside of the end of pawl arm 24.

Figure 2:
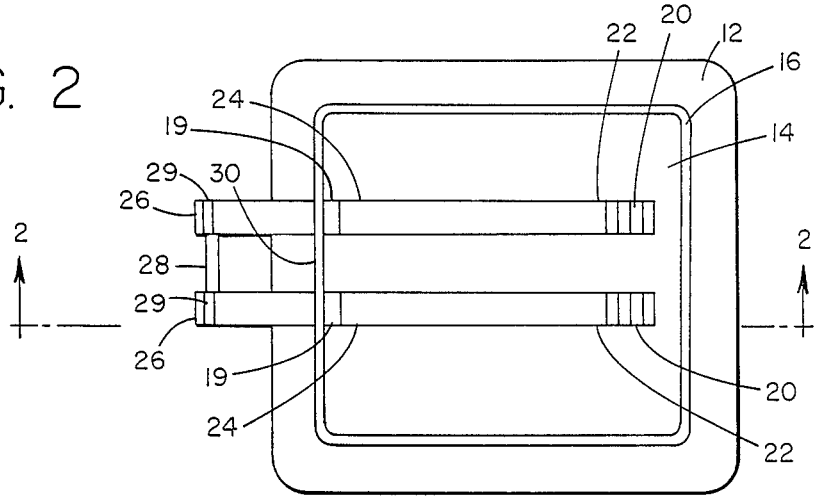
FIG. 2 is a bottom view of the waste container structure and the adjustable package holder.
Figure 3:
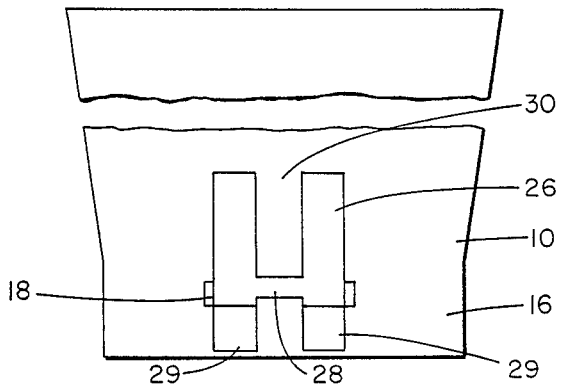
FIG. 3 shows a side view of the container as viewed from the end of the adjustable package holder.

By way of example the structure shown in FIGS. 1, 2 and 3 can be made of any suitable rigid material of either metal, wood, plastic or any other composite material. Suitable materials include aluminum, sheet steel, thermoplastic resin, e.g., polypropylene, polyethylene, impact polystyrene, etc. Container 10 can be of molded polyethylene having a wall thickness of approximately 1/16–3/16 inch. At the underside of the bottom 14 of the container there can be molded dual, spaced bars or tracks of a ratchet. The width of the ratchet teeth can be approximately from 1–1½ inch wide. The teeth of the ratchet bar or track are designed to interengage with a pawl escapement tooth 22 of approximately the same width. The pawl tooth can have a flat pawl arm of molded polyethylene which also can be anywhere from 1/16 to 3/16 in thickness. A pair of pawl arms with associated pawl tooth can be molded in one piece so as to have an upright member at right angles to the pawl arm and of the same thickness. In the case of a pair of pawls they will be molded together and connected by a molded cross member 28.

Waste container liners are normally supplied to the consumer in paperboard boxes which contain a plurality of such liners. The box when full of folded bag liners, has a certain amount of resiliency. These boxes are usually rectangular in shape, having a width which varies depending upon the size and number of folded bags therein. The container usually has a perforated region which can be removed so as to provide access to the folded bags from between members 26. When such a package or box is placed between upright member 26 and area 30 of wall 12 of the waste container it can be securely fixed in this location. By exerting a pushing pressure against upright members 26 the package and the spring action of members 26 will be resilient enough to permit pawl escapement tooth 22 to advance in a package tightening direction over the individual teeth of ratchet bar member 20 until the point is reached where the package is securely held in place between upright members 26 and region 30 of the container wall. If the package thickness decreases, due to the removal of individual bags, it can be kept secure by pushing upright members 26 again in a direction so as to advance escapement tooth 22 to a new and more secure location on ratchet bar 20. The waste container can be of any practical design, e.g., of square or rectangular base, circular or triangular base.

In the manner described above the subject combination provides a means of storing any size package of plastic liner or garbage bags in the proximity of the waste container. In this manner spare bags are always in the vicinity of the waste container. Bag removal from the container and replacement of a used box is quite simple. Providing a waste container with this combination has the added advantage of yielding a highly efficient stackable product which tends to hold down freight costs. An additional advantage of this type of storage and supply system is that it tends to further stabilize the waste container since its center of gravity is lowered by virtue of the position of a supply package.

Although the various aspects of the present invention have been described with respect to the preferred embodiments thereof, it will be understood that the invention is entitled to protection within the full scope of the appended claims.

What is claimed is:

1. The combination comprising a rigid container having a bottom planar surface and a wall member, at least one rachet bar fixed in association with said planar surface, at least one pawl including a pawl escapement tooth and a pawl arm in association therewith; said container having a peripherally depending rigid skirt for offsetting the bottom of said container from a support surface, at least one orifice in said skirt functioning as a fulcrum for said pawl arm located so as to permit said pawl tooth to move into and out of engagement with the teeth of said rachet bar; an upright member fixed at the end of said pawl arm opposite to said pawl tooth and extending in the same direction as said pawl tooth, said pawl tooth and arm being slideable in relation to said rachet bar, fulcrum and wall member; said combination being adapted to receive a package, which is decreasible in size, between said upright member and said wall member, said upright member being structured so as to exert a spring-force against said package when said pawl escapement tooth is in locked engagement with said rachet bar.

2. The combination of claim 1 including a pair of spaced, parallel ratchet bars, a pair of said pawls, a pair of said orifices and a pair of inwardly curved or angled upright members.

3. The combination of claim 2 wherein said pawl arm has a downwardly depending leg at the end opposite to said pawl tooth and adapted to prevent or limit downward movement of said pawl arm.

4. The combination of claim 3 wherein said orifices have shelf members perpendicular thereto functioning as additional support for said pawl arm.

* * * * *